US005560301A

United States Patent [19]

Smith et al.

[11] Patent Number: 5,560,301

[45] Date of Patent: Oct. 1, 1996

[54] SAFETY BARRIER FOR ARTICULATED VEHICLES

[75] Inventors: Morley L. Smith, Beaconsfield; Michel LaLonde, Laval, both of Canada

[73] Assignee: GSM Design Product and Transportation Inc., Canada

[21] Appl. No.: 383,236

[22] Filed: Feb. 3, 1995

[30] Foreign Application Priority Data

Sep. 26, 1994 [CA] Canada ..... 2132911

[51] Int. Cl.[6] ..... B61D 33/00

[52] U.S. Cl. ..... 105/439; 105/4.1; 105/21; 213/221

[58] Field of Search ..... 213/9, 220–223; 105/8.1, 4.1, 10, 14, 21, 439–442

[56] References Cited

U.S. PATENT DOCUMENTS

| | | | |
|---|---|---|---|
| 251,189 | 12/1881 | Conover . | |
| 269,839 | 1/1883 | DuBois . | |
| 686,797 | 11/1901 | Anderson . | |
| 1,142,264 | 6/1915 | Menden . | |
| 1,423,303 | 7/1922 | Brooks . | |
| 1,431,707 | 10/1922 | Tatum | 105/21 |
| 2,584,904 | 2/1952 | Monger . | |
| 3,387,568 | 6/1968 | Hawes | 213/221 |
| 3,532,063 | 10/1970 | Rowe . | |
| 3,712,244 | 1/1973 | Vollenweider et al. | 105/21 |
| 3,884,155 | 5/1975 | Maroshick . | |
| 3,922,971 | 12/1975 | Maroshick . | |
| 4,644,872 | 2/1987 | Vianello | 105/4.1 |

FOREIGN PATENT DOCUMENTS

| | | | |
|---|---|---|---|
| 165076 | 7/1904 | Germany | 105/439 |

*Primary Examiner*—Douglas C. Butler
*Assistant Examiner*—C. T. Bartz
*Attorney, Agent, or Firm*—Diller, Amik & Wight, PC

[57] ABSTRACT

A safety barrier for a subway or railway train including pairs of individual pivoting triangular gate members with a smooth wall panel at the base of the triangle. Each gate member is retractable within a recess in the end wall of the train car near a corner and are expandable to form a partial continuation of the side wall of the train car and to form with an adjacent barrier on the rear end wall a safety barrier to prevent persons from entering the gap between the cars from either side of the train.

8 Claims, 4 Drawing Sheets

SAFETY BARRIER FOR ARTICULATED VEHICLES

BACKGROUND OF THE INVENTION

1. Field of the Invention

The present invention relates to safety barriers for blocking the gap between cars in an articulated train of passenger vehicles, such as subway or railroad trains.

2. Description of the Prior Art

Safety barriers for trains have existed for one hundred years or more, as evidenced from U.S. Pat. Nos. 251,189, Conover, 1881, and 269,839, Du Bois, 1883. Other safety barriers have been developed over the years as proposed by U.S. Pat. Nos. 1,142,264, Menden, 1915; 1,423,303, Brooks, 1922; and 3,532,063, Rowe, 1970. Although such barriers are effective, many subway authorities have not integrated safety barriers on their subway trains. Yet the lack of such barriers for the gap between subway cars is a cause of accidents. In Montreal, Canada, it has been reported that 20 visually impaired people have fallen between train cars of the Metro since it opened in 1967. A blind person was killed in this manner in the summer of 1994.

One can only surmise as to why the prior art barriers are not in use. The pantograph gates described in Menden, U.S. Pat. No. 1,142,264; Brooks, U.S. Pat. No. 1,423,303; and Monger, U.S. Pat. No. 2,584,904, might be the source of other problems, such as someone's clothing getting caught when standing on a platform close to the gate. Furthermore, a child or even an adult might stick a hand or a foot in the spaces formed by the pantograph, which might become wedged as the train leaves the station, dragging the person along. The cables with hooks as shown in Rowe, U.S. Pat. No. 3,532,063, might have similar disadvantages.

The collapsible gates of Conover, U.S. Pat. No. 251,189, and Du Bois, U.S. Pat. No. 269,839, allow the gates to project beyond the lateral dimensions of the cars, which do not meet most specifications for subway or railway cars that require maximum widths on such vehicles in view of the sometimes limited space through which the cars must pass. The overall aesthetics of such cars is also a factor, and generally the prior art alternatives would detract from the appearance of modern car designs.

SUMMARY OF THE INVENTION

It is an aim of the present invention to provide an improved safety barrier to block the gap between cars of a train which overcomes the disadvantages of the prior art.

It is a further aim of the present invention to provide a simple barrier which can blend well into the design of modern cars.

A construction in accordance with the present invention comprises a pair of retractable and expandable safety barriers for the end of a train car, wherein each barrier includes a triangular prism member having a vertical edge at the apex of the triangle and a smooth surface, at the base of the triangle, generated by a straight line parallel to the vertical edge at the apex. Hinge means are located at the vertical edge at the apex in order to mount the member to the end wall of a train car. The gate member thus pivots about a vertical axis at the vertical edge for movement into a recess formed in the wall of the car to retract the member and an expanded position wherein the surface at the base of the triangle is exposed and provides a partial continuation of the side wall of the car. Resilient means urges the member to the expanded position such that when two cars are articulated together, the pairs of members from each car are aligned, and when expanded towards each other, form a safety barrier from each side of the train at the gap between the cars.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 8:
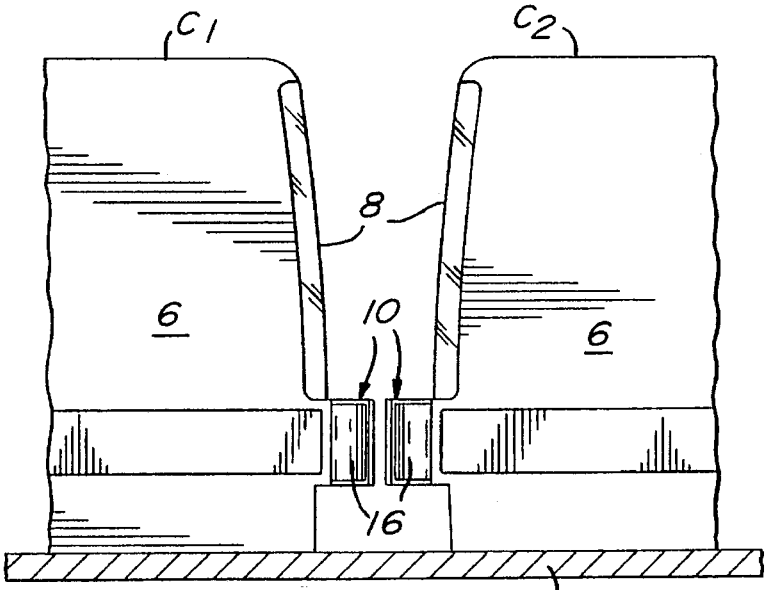
FIG. 8 is a fragmentary side elevation of an embodiment of the present invention as seen from a platform in a subway station.
Figure 4:
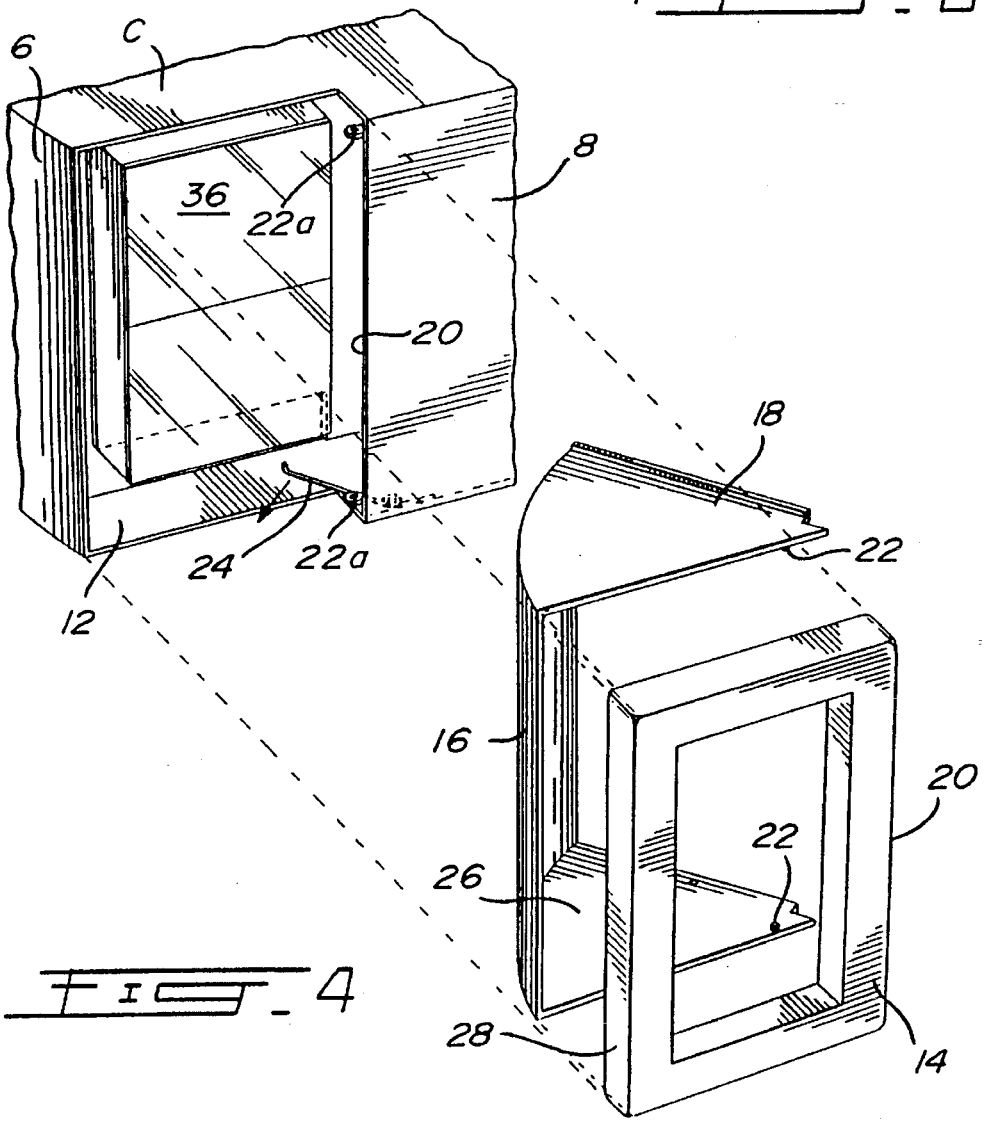
FIG. 4 is an exploded view of the embodiment shown in FIG. 2.
Figure 5:
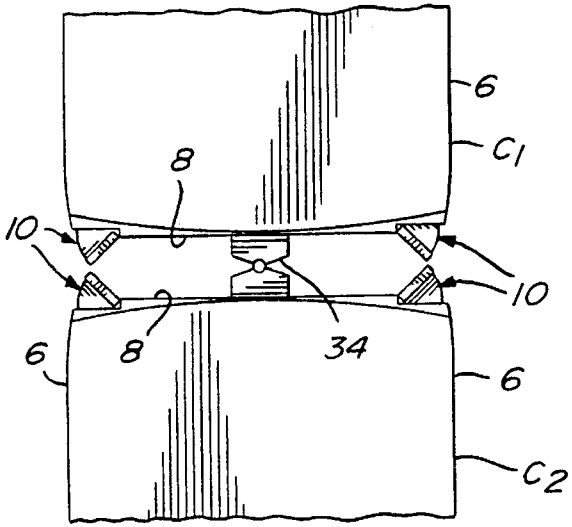

As seen in FIGS. 1 and 5 through 8, the pivoting gates 10 are located at the corners of the end faces 8 of a typical subway car C. In FIGS. 5 through 8, two subway cars are illustrated, namely, cars C1 and C2. Cars C1 and C2 have side walls 6 forming corners with the end walls 8. When the gates 10 are deployed as shown in FIGS. 5 and 8, they block the gap between the end walls 8 of cars C1 and C2 at about waist high.

Figure 1:
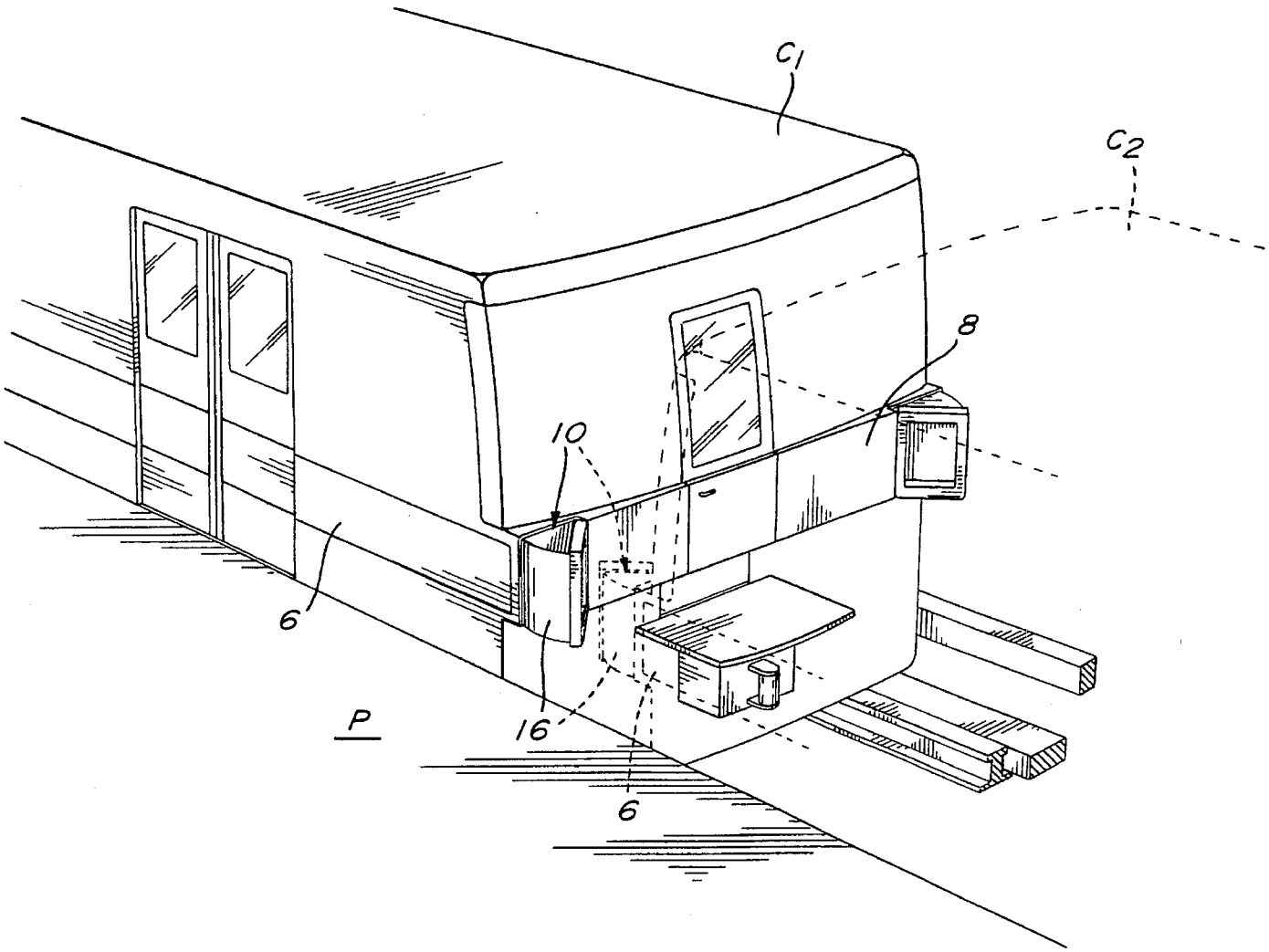
FIG. 1 is a fragmentary perspective view of the front of a train car showing the present invention.
Figure 2:
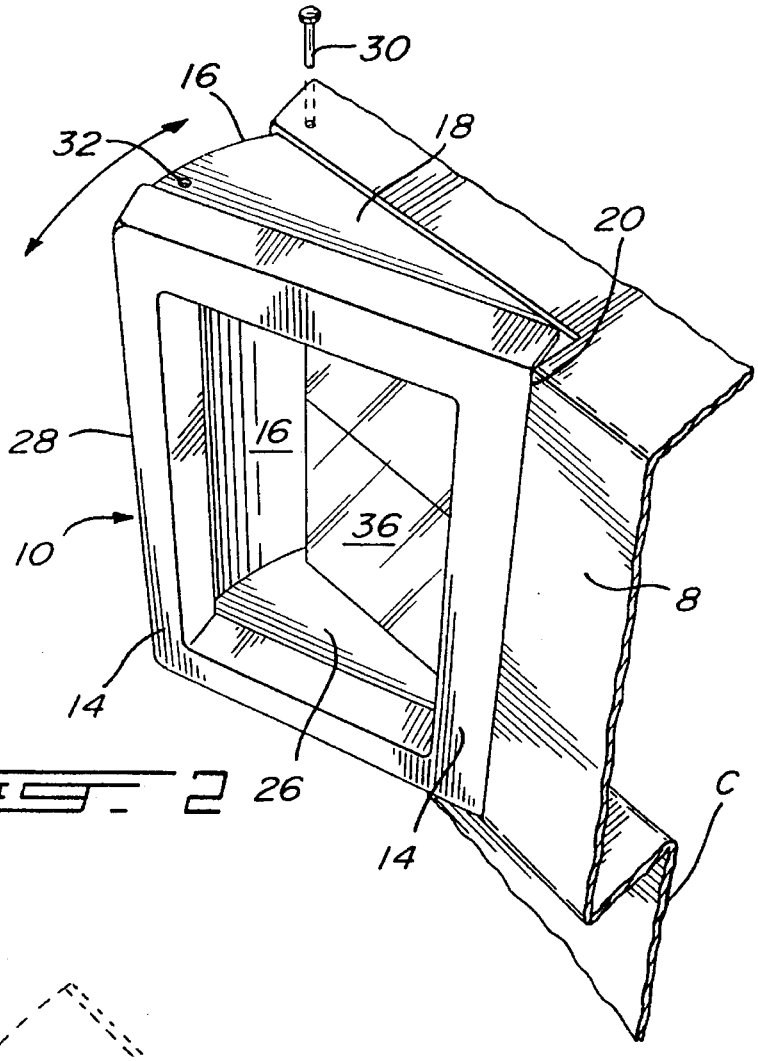
FIG. 2 is an enlarged fragmentary perspective view of the present invention.
Figure 3:
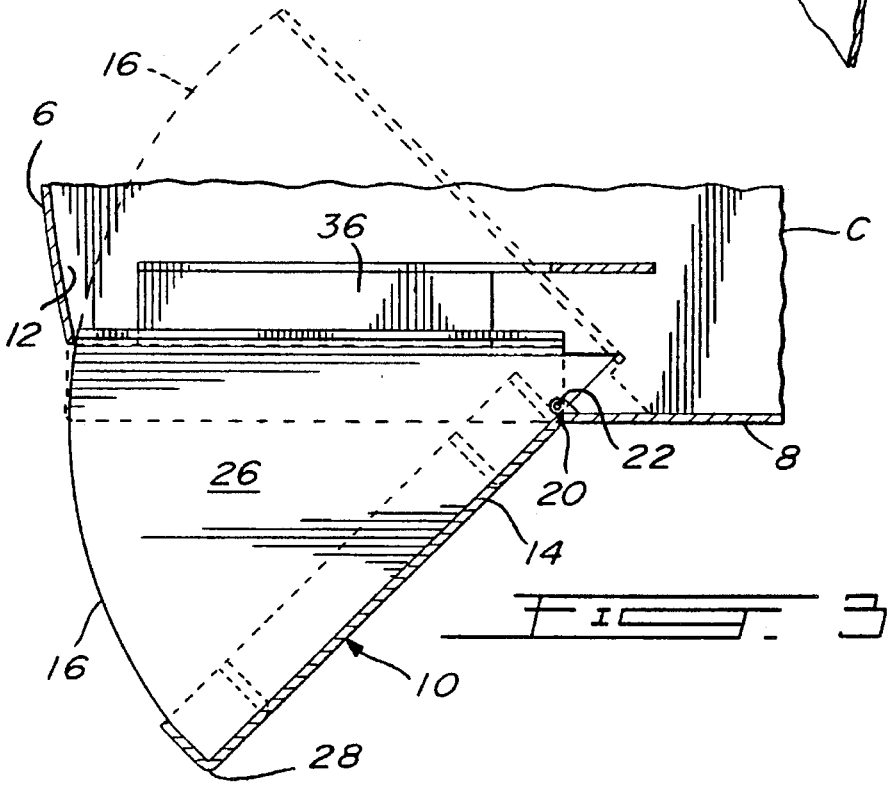
FIG. 3 is a horizontal cross-section taken through the element shown in FIG. 2.

The embodiment shown in the present drawing includes the pivoting gate 10 having a generally triangular prism shape with an arcuate smooth gate panel 16 at the base of the triangle, a top wall 18 and a bottom wall 26. The hinge edge 20 is represented in FIGS. 2 and 3. A bumper frame 14 of rubber or plastics material defines a rectangular opening in the front face of the gate 10. Gate 10 can be hinged to the front wall 8 by means of hinge pins 22 in the top and bottom walls 18 and 26 which engage eyes **22*a* in the vicinity of the hinge edge 20**.

A recess 12 is formed in the wall 8 of car C. In the present embodiment, a head light or tail light 36 is shown as being located within the recess, and the triangular gate 10 is hollow in order to retract around the light 36 within the recess 12, as illustrated in FIGS. 2 and 3.

When car C is at the head or tail of the train, the gates 10 would be retracted within the recess, and thus the bumper frame 14 would be flush with the wall 8. A locking pin 30 could be utilized passing through aperture 32 to maintain the gate 10 in its retracted position against the urging of spring 24.

It is contemplated that a linkage mechanism could be provided in the operator's cab of the car to retract the gates 10 and keep it in the retracted position when the car C is a front or rear car. On all other occasions, the gates 10 will be fully deployed.

Figure 6:
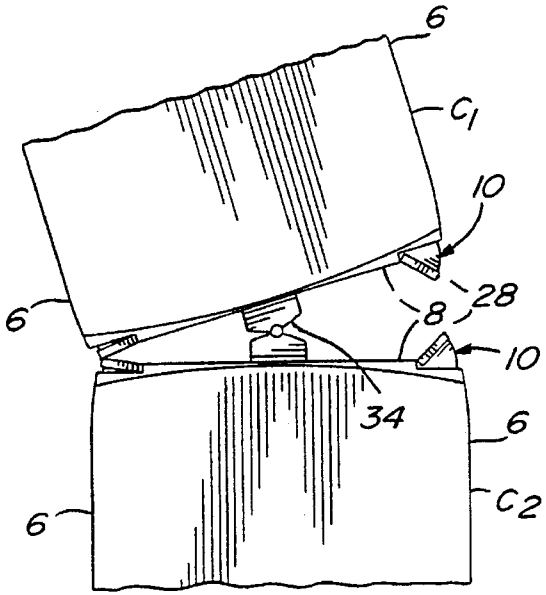

Thus, when car C is within the train and articulated to another car, the gate 10 is usually deployed, thus projecting from the wall 8 under the urging of spring 24. FIG. 5 shows the gates 10 fully deployed. The gate panels 16 partially extend the side walls 6 to block entrance into the gap, formed between the end walls 8 of cars C1 and C2, from a boarding platform. When the train passes on a curve, the opposed gates 10 will abut each other, as shown in FIG. 6, and partially retract within the recesses 12 against their respective springs 24. As soon as the train straightens out, the gates will resume their fully deployed positions.

Figure 7:
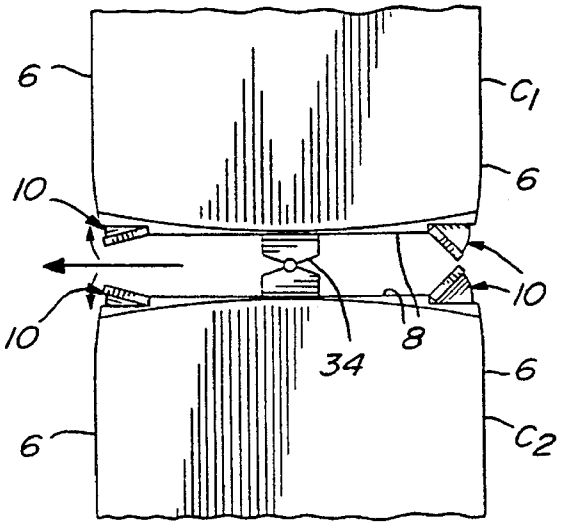
FIGS. 5, 6 and 7 are fragmentary, schematic, top plan views showing an embodiment of the present invention in different operative positions.

Although it is impossible to retract the gates 10 by walking into the gates as one would standing on the platform P of FIG. 8, the gates 10, however, will retract if someone is coming from the opposite direction, that is, from within the gap as shown in FIG. 7. Under emergency conditions, the doors of a subway car may be locked due to loss of power. However, manually operated doors are usually located centrally of the end walls 8, and thus the passengers can disembark from the cars through these doors over a platform covering the couplings 34 through the gap. The gates 10 may be pushed from the direction of the arrow shown in FIG. 7, and thus the gates 10 will be easily retracted against their springs 24. As soon as a passenger has passed, the gates 10 will spring back to their fully deployed or expanded position.

The gates 10 can take any form, but the gate panel 16 must be smooth and uninterrupted. Although it may be a planar surface, it is shown as an arcuate surface in the present application.

Different types of biasing means, such as a coiled spring on a hinged shaft or pneumatic spring means, can be used to deploy the gate 10.

We claim:

1. A safety barrier for the gap formed between train cars comprising a pair of retractable and expandable safety barriers on the end wall of each train car, wherein each barrier includes a gate member having a vertical edge and a panel spaced therefrom having a convexly curved smooth uninterrupted surface generated by a straight line parallel to the vertical edge, at least an arm extending from the panel to the vertical edge of the gate, hinge means located at the vertical edge in order to mount the gate to the end wall of a train car, whereby the gate member can pivot about a vertical axis on the end wall of the train car located near a corner of the end of the train car such that the gate will move into a recess formed in the wall of the train car to retract the member and an expanded position wherein the panel is exposed and provides a partial continuation of the side wall of the train car, resilient means urging the member to the expanded position such that when two cars are articulated together, the pairs of barriers from the opposed end walls of each train car are aligned respectively, and when expanded towards each other, form a safety barrier from each side of the train at the gap between the train cars.

2. A safety barrier as defined in claim 1, wherein the gate is in the form of a triangular prism and the panel is at the base of the triangle while the vertical edge is at the apex of the triangle.

3. A barrier as defined in claim 1, wherein locking means are provided for locking the gates in a retracted position within the recess in the end wall of the train car.

4. A barrier as defined in claim 2, wherein the triangular prism shaped gate is hollow and a light fixture is mounted centrally of the recess in the end wall of the car, and the hollow gate can retract within the recess such that the light fixture is central of the hollow triangular prism shaped gate.

5. A safety barrier kit for train cars, the kit including a gate member to be mounted at each end wall corner of a train car, said gate member having a first pivot axis, a frame to be mounted in the recess of the front end of the car, the gate mounted to the frame including hinge means on the gate member and the frame coincident with the pivot axis, at least an arm extending from the pivot axis and a smooth panel at the end of the arm remote from the pivot axis, the panel being generated by a straight line parallel to the pivot axis and substantially at right angles to the arm, the gate member being adapted to fit in a recess formed at the end wall corner of the car, and a spring means associated with the hinge means urging the gate member to move outwardly from the recess when the kit is installed so that the panel, when fully deployed, forms a partial extension of the side wall of the car projecting forward of the end wall thereof on the urging of the spring.

6. A safety barrier kit as defined in claim 5, wherein the gate member is in the form of a hollow triangular prism having upper and lower arms extending from the pivot axis to the panel.

7. In a train car having end walls and side walls forming corners at the end walls and wherein the cars are articulated one to the other forming gaps between the end walls of adjacent cars, the improvement comprising a pivoting barrier member at each end wall corner with the pivot axes of the two pivoting barrier members being parallel one to the other, each pivoting barrier member including a smooth convexly curved walled gate panel mounted to an arm extending from each pivot axis such that the smooth convexly curved walled gate panel can retract within a recess in each end wall of each car and projects beyond the end wall towards a similar gate panel on the adjacent end wall of the other adjacent car to form a barrier with the other gate panel partially closing the gap on each side of the train, and spring means urges the gate panels in the projected position.

8. In a train car as defined in claim 7, wherein the barrier member is in the form of a triangular hollow prism having upper and lower walls defining arms to which the smooth wall gate panel is mounted, and the barrier moves in and out of the recess in the end wall of the train.

* * * * *